US005608692A

United States Patent [19]

Toda

[11] Patent Number: 5,608,692

[45] Date of Patent: Mar. 4, 1997

[54] MULTI-LAYER POLYMER ELECTROACOUSTIC TRANSDUCER ASSEMBLY

[75] Inventor: Minoru Toda, Lawrenceville, N.J.

[73] Assignee: The Whitaker Corporation, Wilmington, Del.

[21] Appl. No.: 193,348

[22] Filed: Feb. 8, 1994

[51] Int. Cl.[6] ..... H04R 17/00

[52] U.S. Cl. ..... 367/157; 310/325; 310/334; 310/800

[58] Field of Search ..... 310/800, 325, 310/334; 367/152

[56] References Cited

U.S. PATENT DOCUMENTS

| | | | |
|---|---|---|---|
| 4,093,884 | 6/1978 | Dreyfus et al. | 310/328 |
| 4,283,461 | 8/1981 | Wooden et al. | 428/422 |
| 4,296,349 | 10/1981 | Nakanishi et al. | 310/335 |
| 4,330,730 | 5/1982 | Kurz et al. | 310/331 |
| 4,356,422 | 10/1982 | van Maanen | 310/322 |
| 4,383,194 | 5/1983 | Ohigashi et al. | 310/800 |
| 4,405,402 | 9/1983 | Quilliam | 156/273.7 |
| 4,491,760 | 1/1985 | Linvill | 310/334 |
| 4,545,553 | 10/1985 | Finke et al. | 244/134 D |
| 4,638,468 | 1/1987 | Francis | 367/153 |
| 4,653,036 | 3/1987 | Harris et al. | 367/170 |
| 4,675,959 | 6/1987 | Sprout | 29/25.25 |
| 4,695,988 | 9/1987 | Banno | 367/154 |
| 4,704,774 | 11/1987 | Fujii et al. | 29/25.35 |
| 4,712,037 | 12/1987 | Verbeek et al. | 310/323 |
| 4,737,939 | 4/1988 | Ricketts | 367/158 |
| 4,786,837 | 11/1988 | Kalnin et al. | 310/364 |
| 4,795,935 | 1/1989 | Fujii et al. | 310/336 |
| 4,805,157 | 2/1989 | Ricketts | 367/119 |
| 4,833,659 | 5/1989 | Geil et al. | 367/155 |
| 4,900,972 | 2/1990 | Wersing et al. | 310/364 |
| 4,928,264 | 5/1990 | Kahn | 367/141 |
| 5,166,573 | 11/1992 | Brown | 310/334 |
| 5,229,979 | 7/1993 | Scheinbeim et al. | 310/800 |
| 5,317,229 | 5/1994 | Koehler et al. | 310/800 |
| 5,392,259 | 2/1995 | Bolorforsh | 367/152 |

*Primary Examiner*—J. Woodrow Eldred

[57] ABSTRACT

An electroacoustic transducer assembly which comprises multiple layers of piezoelectric polymer material on an acousto-reflective support member. The inner layer closest to the support member is excited at a fixed frequency and the overall thickness of the multiple layers is about one quarter of the wavelength of the wave of fixed frequency within the layers. In a variation of this structure, the inner layer is subdivided into a plurality of thin layers which are excited with alternating polarities.

11 Claims, 5 Drawing Sheets

MULTI-LAYER POLYMER ELECTROACOUSTIC TRANSDUCER ASSEMBLY

BACKGROUND OF THE INVENTION

This invention relates to electroacoustic transducer assemblies and, more particularly, to a high efficiency electroacoustic transducer assembly using piezoelectric polymer material.

One use of electroacoustic transducer assemblies is as probes for certain types of ultrasonic medical diagnostic equipment. When used in such an application, water, rather than air, is typically interposed between the probe and the skin of the patient. This results in a reduction of the reflection of the ultrasonic waves by the skin over the situation where the ultrasonic waves are transmitted through air.

Piezoelectric polymer materials, such as polyvinylidene fluoride (PVDF) or polyvinylidene fluoride-trifluoroethylene (PVDF-TrFE) in film form, are known as relatively inexpensive and comformable materials that can be utilized in such ultrasonic electroacoustic transducer assemblies because their acoustic impedances are close to that of water, which minimizes boundary reflection. Although the frequency responses of such materials, both for transmitting and receiving, cover a much wider frequency band than those of ceramic piezoelectric materials, the magnitudes of generated waves are much weaker than those of ceramic piezoelectric materials. It is therefore a primary object of the present invention to provide an electroacoustic transducer assembly utilizing piezoelectric polymer film material which has increased efficiency.

SUMMARY OF THE INVENTION

The foregoing and additional objects are attained in accordance with the principles of this invention by providing an electroacoustic transducer comprising multiple layers of piezoelectric polymer material on an acousto-reflective support member. The inner layer of polymer material which is closest to the support member is excited at a fixed frequency and the overall thickness of the polymer material layers is about one quarter of the wavelength of the wave of fixed frequency within the layers.

In accordance with an aspect of this invention, there are two layers of polymer material and the thickness of the outer layer is in the range of approximately two to three times the thickness of the inner layer.

In accordance with another aspect of this invention, the inner layer is made up of a plurality of individual layers which are excited with alternating polarities at the fixed frequency.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
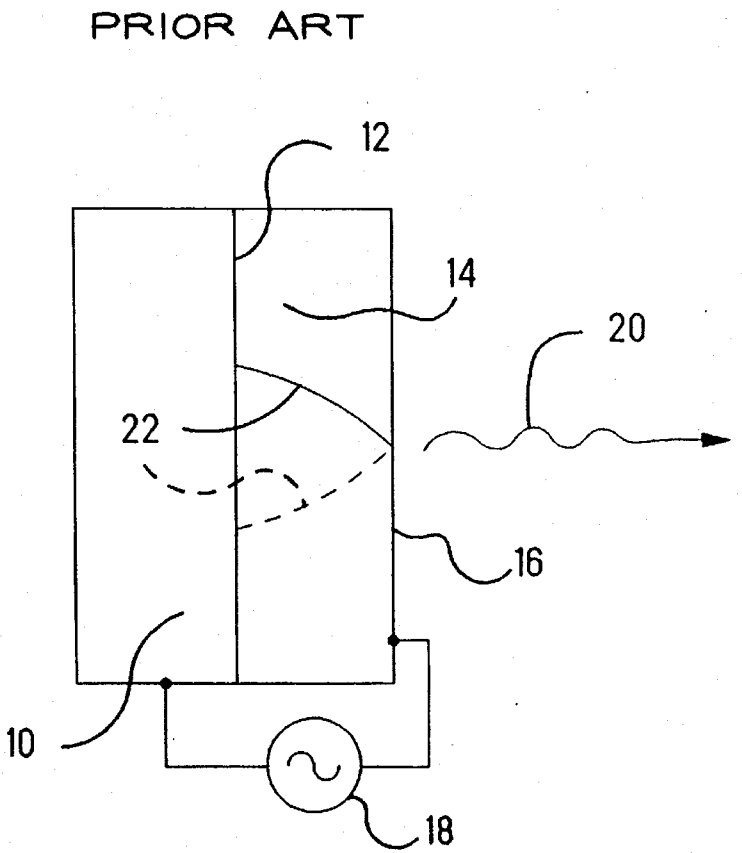
FIG. 1 illustrates a prior art electroacoustic transducer structure upon which the present invention is based.

The basic electroacoustic transducer structure is illustrated in FIG. 1 and includes a support member 10 with a surface 12 on which a layer 14 of piezoelectric polymer material is adhered, in a conventional manner. The support member, or backing layer, 10 is preferably a dense metal, such as, for example, gold, tungsten, platinum, copper or nickel. What is desired is that the support member 10 presents a high coefficient of reflection to acoustic waves impinging on its surface 12.

The surface 16 of the layer 14 is preferably coated with a thin conductive film which acts as a first electrode, the support member 10 functioning as a second electrode. When a source 18 of alternating voltage is connected across the piezoelectric polymer film layer 14, the resultant alternating electric field in the layer 14 sets up a vibration in the layer 14 which causes an acoustic wave 20 to be radiated therefrom. Maximum radiation is attained if the frequency $f_o$ of the source 18 results in a resonant condition. This resonant condition occurs when the thickness of the layer 14 is equal to approximately one quarter of the wavelength of the wave of frequency $f_o$ within the layer 14, as is well known in the art.

Figure 2:
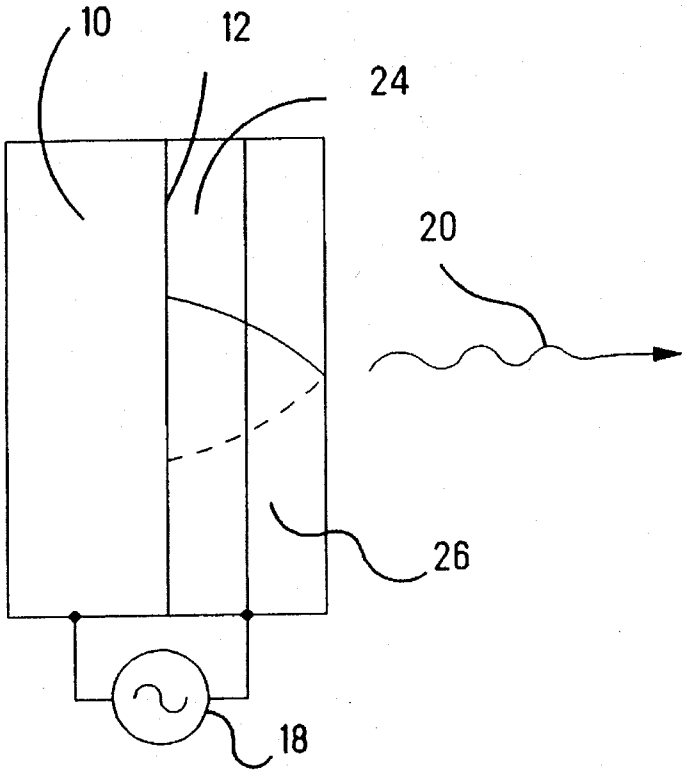
FIG. 2 illustrates an improvement on the structure shown in FIG. 1 in accordance with the principles of this invention.

The curve 22 in FIG. 1 illustrates the stress induced in the layer 14 by a standing acoustic wave at the resonant condition. At the resonant condition, the stress of the standing wave is maximum at the surface 12 and minimum at the surface 16, with the variation being in the form of cosine function. This resonant mode can be excited by applying a varying electric field at the resonant frequency across the thickness of the layer 14. Since the stress of the standing wave in the resonant mode is not uniform across the thickness of the layer 14, the excitation of the standing wave takes place more efficiently in the region close to the surface 12, even though the applied field is uniform. The structure shown in FIG. 2 is therefore more efficient than the structure shown in FIG. 1. As shown in FIG. 2, immediately adjacent the surface 12 of the member 10 is a first layer 24 of piezoelectric polymer material, which is excited by the source 18. Superimposed over the first layer 24 is a second layer 26 of material having substantially the same acoustic properties as the layer 24. The layer 26 is of piezoelectric polymer material which may not be polarized. (If the layer 26 is polarized, it is not excited, so that it acts as if unpolarized.) The overall combined total thickness of the layers 24 and 26 is equal to approximately one quarter of the wavelength of the frequency of the source 8 in the polymer material making up the layers 24 and 6. The resonant condition is therefore satisfied. The structure shown in FIG. 2 induces a higher electric field in the layer 24 than is induced in the layer 14 of FIG. 1 for the same applied voltage and is therefore more efficient than the structure shown in FIG. 1.

Figure 3B:
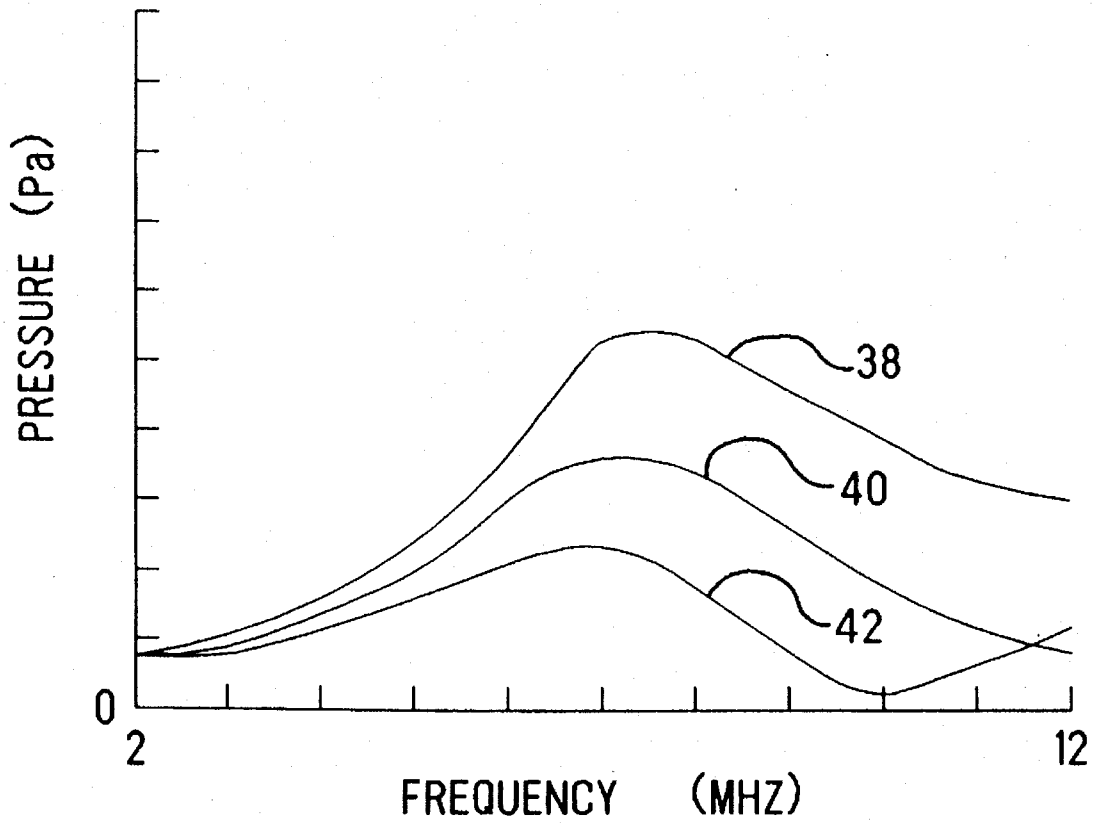
FIG. 3A illustrates the structure shown in FIG. 2 showing various connection points for the application of an electric field and FIG. 3B is a graph of acoustic pressure versus frequency for the structure shown in FIG. 3A, with the different curves therein corresponding to different points of application of the electric field.
Figure 3A:
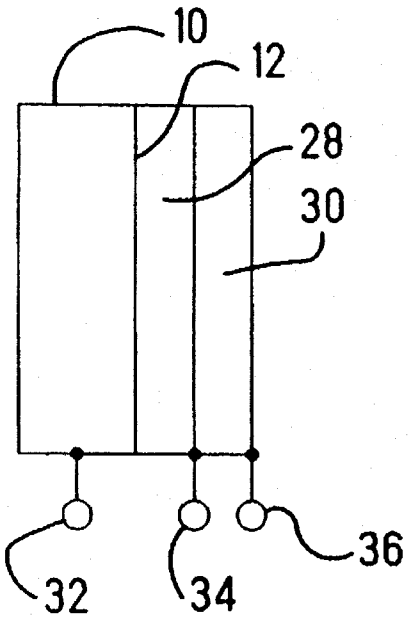

FIG. 3 illustrates a transducer wherein the layers 28 and 30 are both of piezoelectric polymer material and in which the polarizations of the layers are in the same direction. The layers 28 and 30 are of equal thickness. Illustratively, at a frequency of 7.5 MHz, one quarter of the wavelength at that frequency in PVDF-TrFE polymer material is equal to 80 microns, so each of the layers 28 and 30 is of thickness 40 microns. (For PVDF material, the one quarter wavelength of 7.5 MHz is slightly less than 80 microns.) Referring to FIG. 3B, the curves therein of acoustic pressure versus frequency were calculated using Mason's model. The curve 38 is for the condition where the source 18 is placed across the terminals 32 and 34, so that only the layer 28 is excited. The curve 40 is for the condition where the source 18 is placed across the terminals 32 and 36, so that both of the layers 28 and 30 are excited. The curve 42 is for the condition where the source 18 is placed across the terminals 34 and 36, so that only the layer 30 is excited. It will be noted that the greatest output from the transducer is attained when only the layer 28, which is closest to the support member 10, is excited.

Figure 4B:
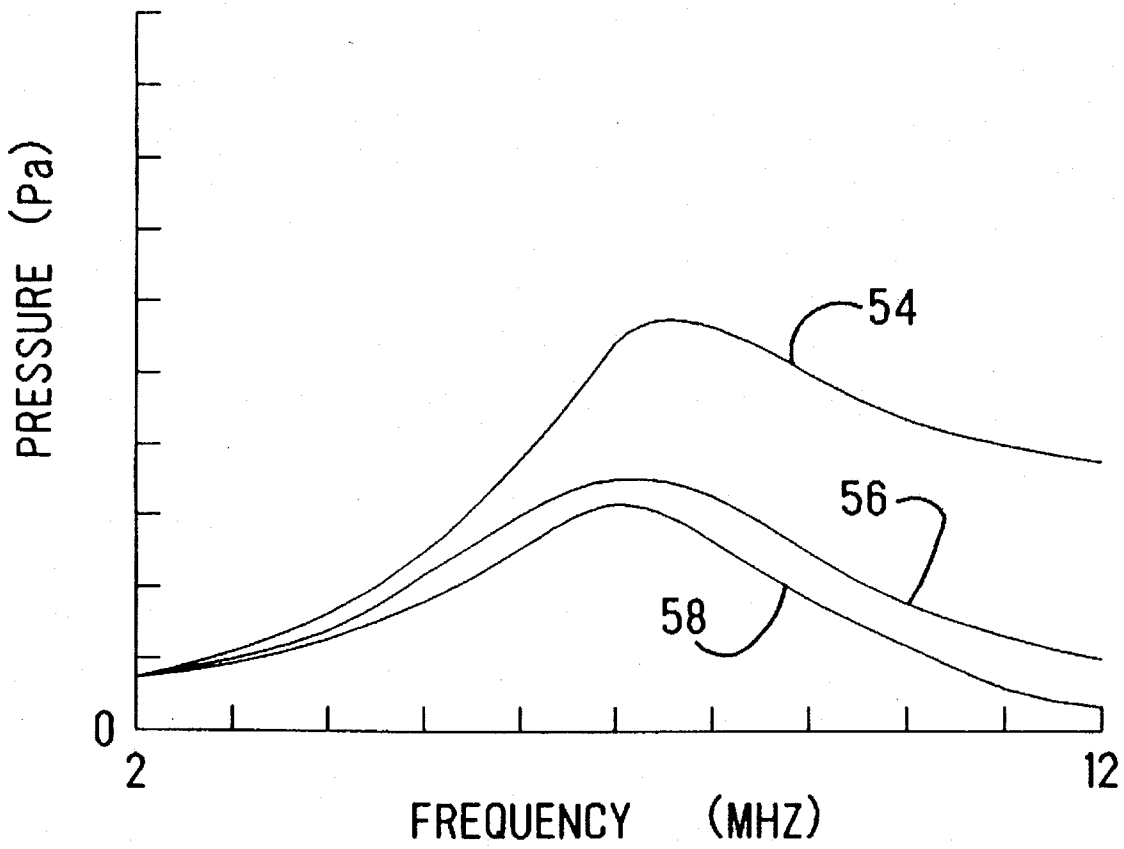
FIG. 4B shows curves of acoustic pressure versus frequency for the structure shown in FIG. 4A.
Figure 4A:
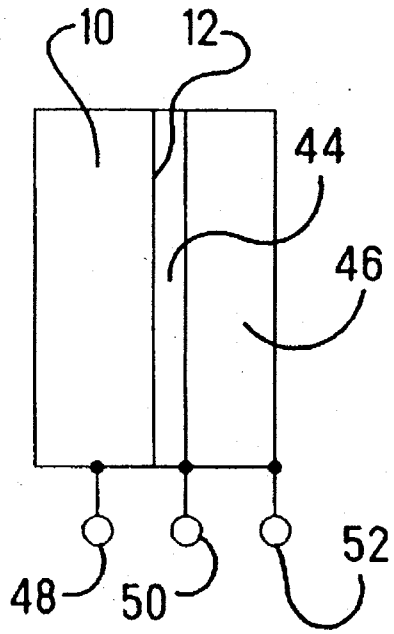
FIG. 4A shows a modification to the structure of FIG. 3A

FIG. 4A illustrates a transducer wherein the layer 44 is 20 microns thick and the layer 46 is 60 microns thick, for a combined thickness of 80 microns, which is one quarter of the wavelength at 7.5 MHz in PVDF-TrFE polymer material. Both layers are polarized in the same direction. The curves of acoustic pressure versus frequency in FIG. 4B were calculated using Mason's model. The curve 54 in FIG. 4B results when the source 18 is placed across the terminals 48 and 50, so as to excite only the layer 44. The curve 56 results when the source 18 is placed across the terminals 48 and 52, so as to excite both the layers 44 and 46. The curve 58 results when the source 18 is placed across the terminals 50 and 52, so as to excite only the layer 46. It is noted that the highest output is attained when only the inner layer 44 is excited, and it is also noted that this output is higher than that for the embodiment of FIG. 3A (curve 38 of FIG. 3B), where the inner layer 28 of piezoelectric polymer material is thicker.

Figure 5B:
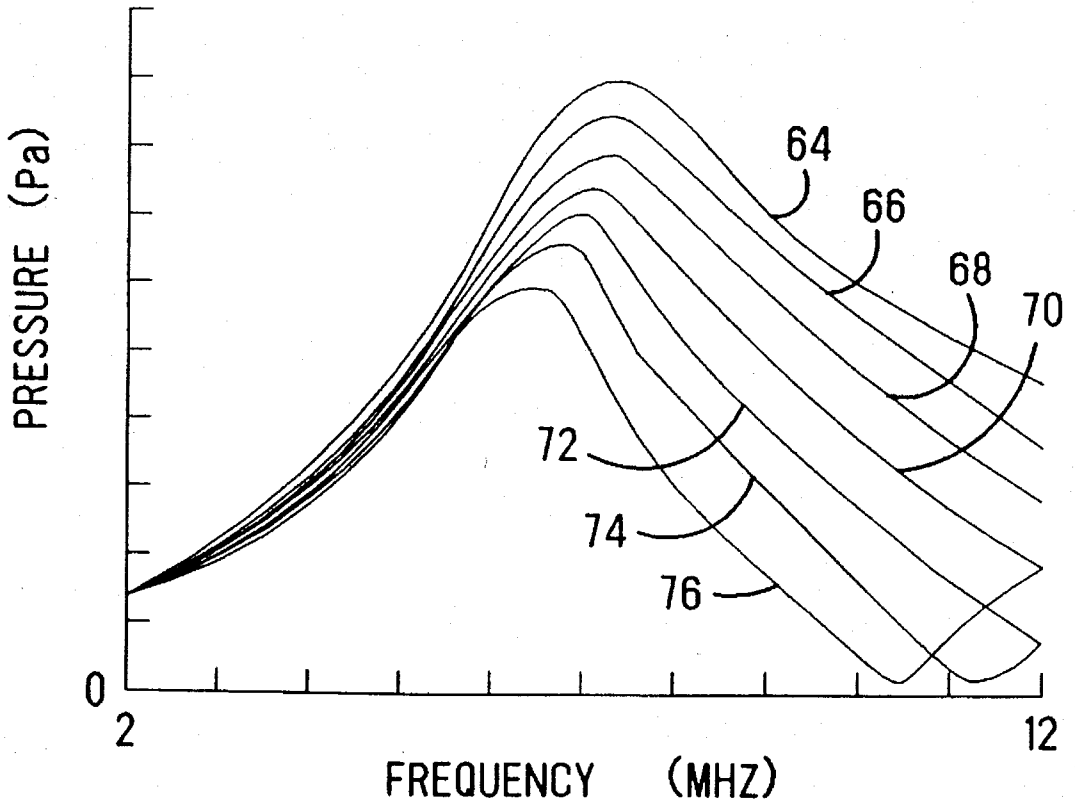
FIG. 5B is a graph of acoustic pressure versus frequency for the structure shown in FIG. 5A, with the different curves therein corresponding to different combinations of thicknesses of the piezoelectric polymer layers.
Figure 5A:
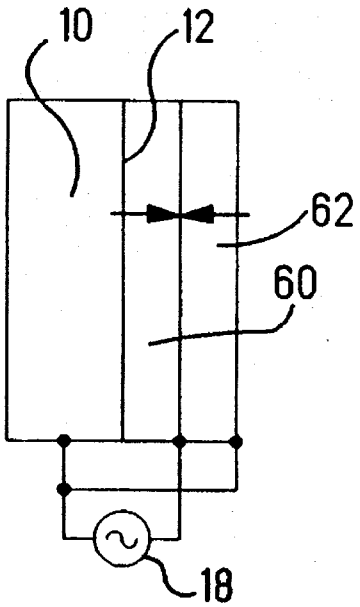
FIG. 5A illustrates a specific application of a varying electric field to the structure shown in FIG. 3A

FIG. 5A illustrates a transducer structure where the layers 60 and 62 are polarized in opposite directions and are excited with opposite polarities. Since the excitation efficiencies of the layers 60 and 62 are different, their thicknesses do not have to be equal. The curves of acoustic pressure versus frequency shown in FIG. 5B were calculated using Mason's model and are for different combinations of thickness of the layers 60 and 62, with the total combined thickness remaining at 80 microns. Thus, the curve 64 is for the case where the thickness of the layer 60 is 10 microns and the thickness of the layer 62 is 70 microns. The curve 66 is for the case where the thickness of the layer 60 is 20 microns and the thickness of the layer 62 is 60 microns. The curve 68 is for the case where the thickness of the layer 60 is 30 microns and the thickness of the layer 62 is 50 microns. The curve 70 is for the case where the thickness of each layer is 40 microns. The curve 72 is for the case where the thickness of the layer 60 is 50 microns and the thickness of the layer 62 is 30 microns. The curve 74 is for the case where the thickness of the layer 60 is 60 microns and the thickness of the layer 62 is 20 microns. The curve 76 is for the case where the thickness of the layer 60 is 70 microns and the thickness of the layer 62 is 10 microns. As is apparent from FIG. 5B, greater output is attained when the layer 60 is thinner than the layer 62. This is because the electric field is stronger for the thinner layer (i.e., the resultant stress is stronger for the thinner layer) and because excitation of the acoustic wave by the thinner layer becomes more effective when it is located at the side closer to the support member 10.

Figure 7:
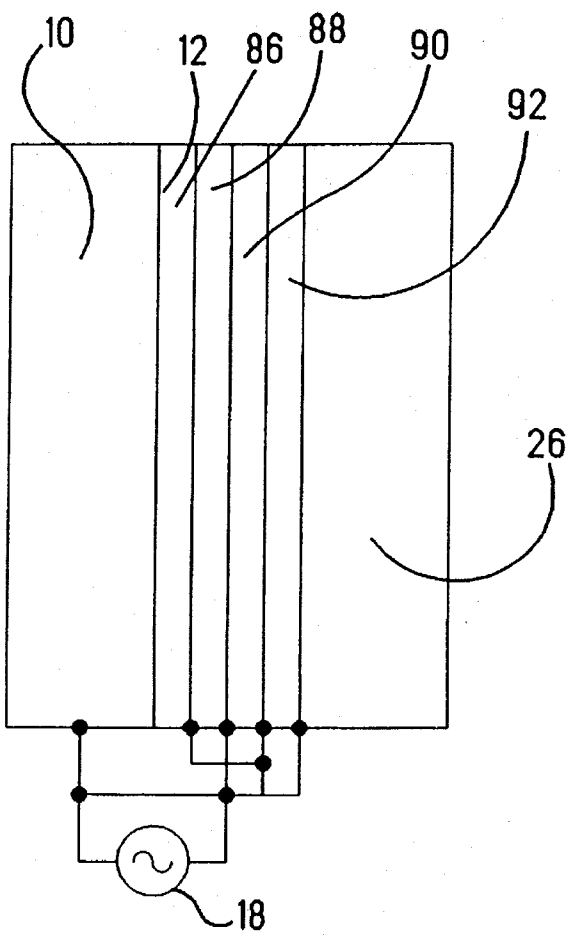
FIG. 7 illustrates yet another embodiment according to the present invention.
Figure 6:
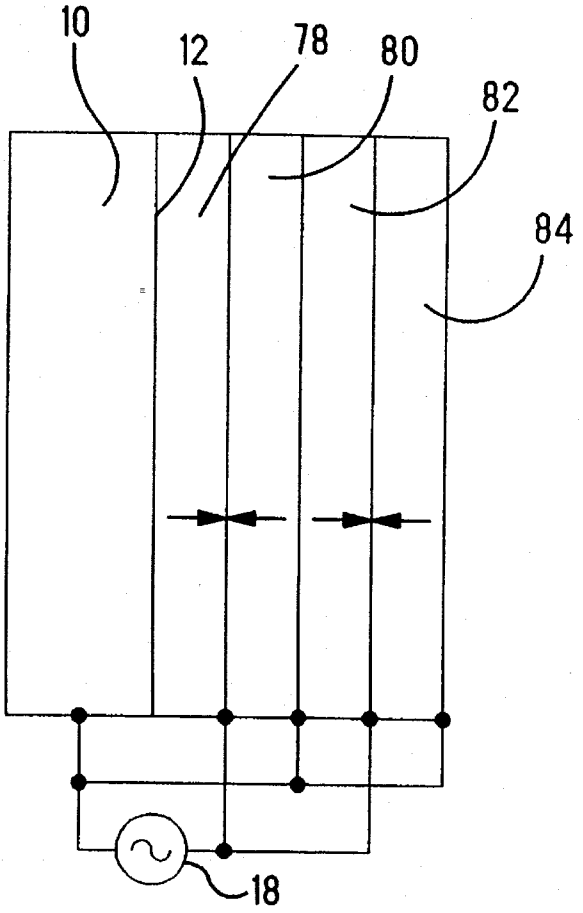
FIG. 6 illustrates a further embodiment according to the present invention.

In order to increase the acoustic output, the piezoelectric layers can be subdivided into thin multiple layers. FIG. 6 illustrates a multi-layer structure corresponding to that shown in FIG. 1 wherein the piezoelectric layer 14 is subdivided into the layers 78, 80, 82 and 84, with polarization directions opposite to that of adjacent layers, which are then excited with alternating polarities. FIG. 7 illustrates a multi-layer structure corresponding to the structure shown in FIG. 2 wherein the piezoelectric layer 24 is subdivided into the layers 86, 88, 90 and 92, which have superimposed thereon the non-piezoelectric layer 26. The inner layers 86, 88, 90 and 92 are excited with alternating polarities. It can be shown that the structure shown in FIG. 7 is more efficient than the structure shown in FIG. 6, for the same reasons that the structure of FIG. 2 is more efficient than the structure of FIG. 1.

Although the improved electroacoustic transducer assembly has been discussed in terms of a transmitter, with the piezoelectric polymer film being excited to set up a standing wave, it is understood that such structure also acts as a receiver so that an impinging acoustic wave is converted into an electrical output signal by the piezoelectric film, and the improved efficiency discussed above also applies to the use of the transducer assembly as a receiver, when induced current or charge is used for the received signal.

The preferred thickness of the excited piezoelectric polymer layer is in the range from about one quarter to about one third of the one quarter wavelength because the standing wave stress curve is a cosine function which flattens, and therefore the result of using a thinner film is that the film becomes "saturated". It is preferred to use a similar polymer material as the non-excited non-piezoelectric layer to keep the resonant frequency at the desired value. This provides a broader resonance. In accordance with this invention, the thickness of the excited piezoelectric layer is reduced so as to increase the induced stress without requiring an increase of voltage beyond the capability of the electronics driving the transducer. The thickness reduction of the film is limited by the ability of the film to withstand a maximum electric field.

Accordingly, there have been disclosed improved high efficiency electroacoustic transducer assemblies using piezoelectric polymer material. While illustrative embodiments of the present invention have been disclosed herein, it is understood that various modifications and adaptations to the disclosed embodiments will be apparent to those of ordinary skill in the art and it is intended that this invention be limited only by the scope of the appended claims.

What is claimed is:

1. A a piezoelectric transducer comprising backing layer having a lower surface and an upper surface;

A first layer of polymer piezoelectric material having a lower surface and an upper surface, said lower surface disposed on said upper surface of said backing layer;

A second layer of polymer piezoelectric material having a lower surface and an upper surface, said lower surface disposed on said upper surface of said first layer of material; and A source of alternating electric voltage applied between said first layer of material and said backing layer by selectively disposed terminals creating an acoustic wave in said first layer and said second layer of material, said first and second layers of film having a total thickness having a wavelength approximately equal to one quarter of the wavelength of said acoustic wave in said layer of film.

2. A piezoelectric transducer assembly as recited in claim 1, wherein said second layer of piezoelectric material is not polarized.

3. A piezoelectric transducer as recited in claim 1, wherein said source of alternating electric voltage creates an electric field in said first layer of piezoelectric polymer material which induces said first and second layers of piezoelectric material to resonate.

4. A piezoelectric transducer as recited in claim 1, wherein said first layer of piezoelectric material is polarized in one direction and said second layer of piezoelectric material is polarized in the same direction as said first layer.

5. A piezoelectric transducer as recited in claim 1, wherein said first layer of piezoelectric material is polarized a first direction and said second layer of piezoelectric material is polarized second direction opposite to the said first direction of said first layer.

6. A piezoelectric transducer as recited in claim 1, wherein said first and said second layer of piezoelectric material are of equal thicknesses.

7. A a piezoelectric transducer comprising backing layer having a lower surface and an upper surface;

A multi-layer of polymer piezoelectric material having a bottom surface and a top surface, said bottom surface disposed on said upper surface of said backing layer; and A source of alternating electric voltage applied between said multi-layer of material and said backing layer by selectively disposed terminals creating an acoustic wave in said multi-layer of material, said multi-layer having a total thickness having a wavelength approximately equal to one quarter of the wavelength of said acoustic wave in said multi-layer of polymer piezoelectric material.

8. A piezoelectric transducer as recited in claim 7, wherein said multi-layer further comprises layers of piezoelectric polymer material having alternating polarization directions.

9. A piezoelectric transducer as recited in claim 7, wherein a layer of non-piezoelectric material is disposed on said top surface of said multi-layer of piezoelectric material.

10. A piezoelectric transducer as recited in claim 7 wherein said multilayer further comprises a first layer having a first thickness and at least a second layer having a second thickness, said first thickness being less than said second thickness.

11. A piezoelectric transducer as recited in claim 1 wherein said first layer has a first thickness and said second layer has a second thickness, said first thickness being less than said second thickness.

* * * * *